US007254532B2

(12) United States Patent
Fischer et al.

(10) Patent No.: US 7,254,532 B2
(45) Date of Patent: Aug. 7, 2007

(54) METHOD FOR MAKING A VOICE ACTIVITY DECISION

(75) Inventors: Alexander Kyrill Fischer, Griesheim (DE); Christoph Erdmann, Aachen (DE)

(73) Assignee: Deutsche Telekom AG, Bonn (DE)

( * ) Notice: Subject to any disclaimer, the term of this patent is extended or adjusted under 35 U.S.C. 154(b) by 820 days.

(21) Appl. No.: 10/258,643

(22) PCT Filed: Mar. 16, 2001

(86) PCT No.: PCT/EP01/03056

§ 371 (c)(1),
(2), (4) Date: Oct. 25, 2002

(87) PCT Pub. No.: WO01/84536

PCT Pub. Date: Nov. 8, 2001

(65) Prior Publication Data

US 2003/0078770 A1 Apr. 24, 2003

(30) Foreign Application Priority Data

Apr. 28, 2000 (DE) ..... 100 20 863
May 31, 2000 (DE) ..... 100 26 872

(51) Int. Cl.
*G10L 11/02* (2006.01)

(52) U.S. Cl. ..... 704/200; 704/205; 704/211; 704/233

(58) Field of Classification Search ..... None
See application file for complete search history.

(56) References Cited

U.S. PATENT DOCUMENTS 4,133,976 A 1/1979 Atal et al.
5,459,814 A 10/1995 Gupta et al. ..... 395/2.42
5,579,431 A 11/1996 Reaves ..... 395/2.23
5,596,676 A * 1/1997 Swaminathan et al. ..... 704/208
5,689,615 A * 11/1997 Benyassine et al. ..... 704/219
5,724,414 A * 3/1998 Dimolitsas et al. .... 379/100.17
5,734,789 A * 3/1998 Swaminathan et al. ..... 704/206

(Continued)

FOREIGN PATENT DOCUMENTS

DE 4020633 1/1992

(Continued)

OTHER PUBLICATIONS

Elenius et al., "Effects of Emphasizing Transitional or Staionar Parts of the speech Signal in a Discrete Utterance Recognition System", IEEE Prc of the Int'l Conference on ASSP, 1982, pp. 535-538.*

(Continued)

*Primary Examiner*—David D. Knepper
(74) *Attorney, Agent, or Firm*—Darby & Darby

(57) ABSTRACT

The invention relates to a method for determining voice activity in a signal section of an audio signal. The result, i.e., whether voice activity is present in the section of the signal thus observed, depends upon spectral and temporal stationarity of the signal section and/or prior signal sections. In a first step, the method determines whether there is spectral stationarity in the observed signal section. In a second step, the method determines whether there is temporal stationarity in the signal section in question. The final decision as to the presence of voice activity in the signal section observed depends upon the initial values of both steps.

21 Claims, 1 Drawing Sheet

U.S. PATENT DOCUMENTS

| | | | | |
|---|---|---|---|---|
| 5,812,965 | A * | 9/1998 | Massaloux | 704/205 |
| 5,963,621 | A * | 10/1999 | Dimolitsas et al. | 379/93.08 |
| 6,003,003 | A * | 12/1999 | Asghar et al. | 704/243 |
| 6,134,524 | A * | 10/2000 | Peters et al. | 704/233 |
| 6,188,981 | B1 * | 2/2001 | Benyassine et al. | 704/233 |
| 6,327,562 | B1 * | 12/2001 | Proust | 704/219 |
| 6,427,134 | B1 * | 7/2002 | Garner et al. | 704/233 |
| 6,512,996 | B1 * | 1/2003 | Praskovsky et al. | 702/189 |
| 2001/0014854 | A1 | 8/2001 | Stegmann et al. | 704/211 |

FOREIGN PATENT DOCUMENTS

| | | |
|---|---|---|
| DE | 69017074 | 2/1995 |
| DE | 19716862 | 10/1998 |
| DE | 69420027 | 8/1999 |
| DE | 69421498 | 11/1999 |
| EP | 0397564 | 2/1995 |
| EP | 0653091 | 5/1995 |
| EP | 0683916 | 11/1995 |
| WO | 9801847 | 1/1998 |
| WO | WO-00 13174 A1 | 3/2000 |

OTHER PUBLICATIONS

Garner et al. "Robust noise detection for speech detection and enhancement" Feb. 13, 1997; Electronic Letters vol. 33.

Ick Don Lee et al. "A voice activity detection algorithm for communications systems with dynamically varying background noise", IEEE, May 18, 1998; pp. 1214-1218.

Hagen et al.: "An 8 KBIT/S Acelp Coder With Improved Background Noise Performance"; Audio and Visual Technology Research Ericson Radio Systems AB S-164 80 Stockholm Sweden, p. 25-28.

Freeman, D.K, et al.: "The Voice Activity Detector For the Pan-European Digital Cellular Mobile Telephone Service"; PROC. Of IEEE ICASSP, 1989, pp. 369-372.

Srinivasan, K., et al.; "Voice Activity Detection For Cellular Networks"; PROC. Of The IEEE Workshop On Speech Coding For Telecommunications, Oct. 13, 1993, pp. 85-86.

* cited by examiner

METHOD FOR MAKING A VOICE ACTIVITY DECISION

BACKGROUND

The present invention relates to a method for determining speech, or voice, activity in a signal segment of an audio signal, the result of whether speech activity is present in the observed signal segment depending both on the spectral and on the temporal stationarity of the signal segment and/or on preceding signal segments.

In the domain of speech transmission and in the field of digital signal and speech storage, the use of special digital coding methods for data compression purposes is widespread and mandatory because of the high data volume and the limited transmission capacities. A method which is particularly suitable for the transmission of speech is the Code Excited Linear Prediction (CELP) method which is known from U.S. Pat. No. 4,133,976. In this method, the speech signal is encoded and transmitted in small temporal segments ("speech frames", "frames", "temporal section", "temporal segment") having a length of about 5 ms to 50 ms each. Each of these temporal segments or frames is not represented exactly but only by an approximation of the actual signal shape. In this context, the approximation describing the signal segment is essentially obtained from three components which are used to reconstruct the signal on the decoder side: Firstly, a filter approximately describing the spectral structure of the respective signal section; secondly, a so-called "excitation signal" which is filtered by this filter; and thirdly, an amplification factor (gain) by which the excitation signal is multiplied prior to filtering. The amplification factor is responsible for the loudness of the respective segment of the reconstructed signal. The result of this filtering then represents the approximation of the signal portion to be transmitted. The information on the filter settings and the information on the excitation signal to be used and on the scaling (gain) thereof which describes the volume must be transmitted for each segment. Generally, these parameters are obtained from different code books which are available to the encoder and to the decoder in identical copies so that only the number of the most suitable code book entries has to be transmitted for reconstruction. Thus, when coding a speech signal, these most suitable code book entries are to be determined for each segment, searching all relevant code book entries in all relevant combinations, and selecting the entries which yield the smallest deviation from the original signal in terms of a useful distance measure.

There exist different methods for optimizing the structure of the code books (for example, multiple stages, linear prediction on the basis of the preceding values, specific distance measures, optimized search methods, etc.). Moreover, there are different methods describing the structure and the search method for determining the excitation vectors.

Frequently, the task arises to classify the character of the signal located in the present frame to allow determination of the coding details, for example, of the code books to be used, etc. In this context, a so-called "voice activity decision" (voice activity detection, VAD) is frequently made as well, which indicates whether or not the currently present signal section contains a speech segment. A correct decision of this type must also be made when background noises are present, which makes the classification more difficult.

SUMMARY OF THE INVENTION

In the approach set forth herein, the VAD decision is equated to a decision on the stationarity of the current signal so that the degree of the change in the essential signal properties is thus used as the basis for the determination of the stationarity and the associated speech activity. Along these lines, for instance, a signal region without speech which, for example, only contains a constant-level background noise which does not change or changes only slightly in its spectrum, is then to be considered stationary. Conversely, a signal section including a speech signal (with or without the presence of the background noise) is to be considered not stationary, that is, non-stationary. Along the lines of the VAD, therefore, the result "non-stationary" is equated to speech activity in the method set forth here while "stationary" means that no speech activity is present.

Since the stationarity of a signal is not a clearly defined measurable variable, it will be defined more precisely below.

In this context, the presented method assumes that a determination of stationarity should ideally be based on the time rate of change of the short-term average value of the signal energy. However, such an estimate is generally not possible directly because it can be influenced by different disturbing boundary conditions. Thus, the energy also depends, for example, on the absolute loudness of the speaker which, however, should have no effect on the decision. Moreover, the energy value is also influenced, for example, by the background noise. Hence, the use of a criterion which is based on energy considerations is only useful if the influence of these possible disturbing effects can be ruled out. For this reason, the method is made up of two stages: In the first stage, a valid decision on stationarity is already made. If in the first stage, the decision is "stationary", then the filter describing this stationary signal segment is recomputed and thereby adapted in each case to the last stationary signal. In the second stage, however, this decision is made once more on the basis of another criterion, thus being checked and possibly changed using the values provided in the first stage. In this context, this second stage works using an energy measure. Moreover, the second stage produces a result which is taken into account by the first stage in the analysis of the subsequent speech frame. In this manner, there is feedback between these two stages, ensuring that the values produced by the first stage forn an optimal basis for the decision of the second stage.

DETAILED DESCRIPTION

CROSS-REFERENCE TO RELATED APPLICATIONS

Figure 1:
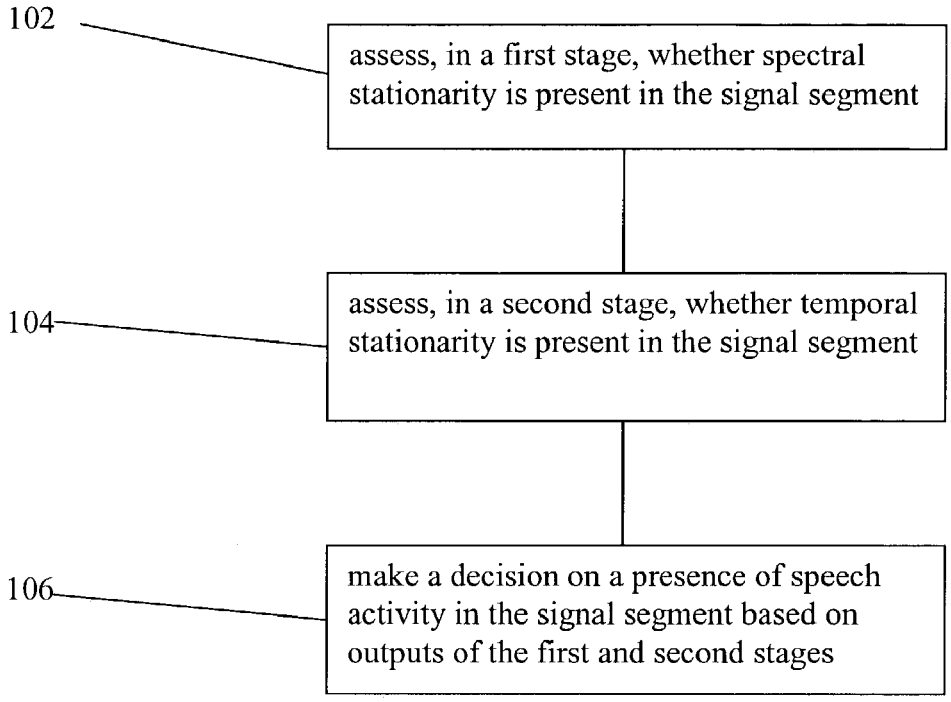
FIG. 1 shows a flow chart of a method for determining speech activity in a signal segment of an audio signal.

This application is a U.S. National Stage Application under 35 U.S.C. §371 of PCT International Application No. PCT/EP01/03056, filed Mar. 13, 2001, which claims priority to German Patent Application No. 100 20 863.0, filed Apr. 28, 2000, and German Patent Application No. 100 26 872.2, filed May 31, 2000. Each of these applications is hereby incorporated by reference as if set forth in its entirety.

The principle of operation of the two stages will be presented separately below.

Referring to FIG. 1, in a method for determining speech activity in a signal segment of an audio signal, in a first stage it is assessed whether spectral stationarity is present in the signal segment (block 102). In a second stage it is assessed whether temporal stationarity is present in the signal segment (block 104). A decision on the presence of speech activity in the signal segment is made based on outputs of the first and second stages (block 106).

Initially, the first stage is presented which produces a first decision based on the analysis of the spectral stationarity. If the frequency spectrum of a signal segment is looked at, it has a characteristic shape for the observed period of time. If the change in the frequency spectra of temporally successive signal segments is sufficiently low, i.e., the characteristic shapes of the respective spectra are more or less maintained, then one can speak of spectral stationarity.

The result of the first stage is denoted by STAT1 and the result of the second stage is referred to as STAT2. STAT2 also corresponds to the final decision of the here presented VAD method. In the following, lists including a plurality of values in the form "list name [0 . . . N−1]" will be described; a single value being denoted via list name [k], k=0 . . . N−1, namely the value indexed by k of the list of values "list name".

Spectral Stationarity (Stage 1)

This first stage of the stationarity method obtains the following quantities as input values:

linear prediction coefficients of the current frame
a) (LPC_NOW[0 . . . ORDER−1]; ORDER=14)

a measure for the voicedness of the current frame (STIMM[0 . . . 1])

the number of frames (N_INSTAT2, values =0, 1, 2, etc.) which have been classified as "non-stationary" by the second stage of the algorithm in the analysis of the preceding frames different values (STIMM_MEM[0 . . . 1 ], LPC_STAT1 [0 . . . ORDER−1]) computed for the preceding frame The first stage produces, as output, the values first decision on stationarity: STAT1 (possible values: "stationary", "non-stationary"

linear prediction coefficients of the last frame classified as "stationary" (LPC_STAT1)

The decision of the first stage is primarily based on the consideration of the so-called "spectral distance" ("spectral difference", "spectral distortion") between the current and the preceding frames. The values of a voicedness measure which has been computed for the last frames are also considered in the decision. Moreover, the threshold values used for the decision are influenced by the number of immediately preceding frames classified as "stationary" in the second stage (i.e., STAT2="stationary"). The individual calculations are explained below:

a) Calculation of the Spectral Distance:

The calculation is given by:

$$SD = \sqrt{\frac{1}{2\pi}\int_{-\pi}^{\pi}\left(10\log\left[\frac{1}{|A(e^{j\omega})|^2}\right] - 10\log\left[\frac{1}{|A'(e^{j\omega})|^2}\right]\right)^2 d\omega}\,.$$

In this context, $$10\log\left[\frac{1}{|A(e^{j\omega})|^2}\right]$$

denotes the logarithmized frequency response envelope of the current signal segment which is calculated from LPC_NOW.

$$10\log\left[\frac{1}{|A'(e^{j\omega})|^2}\right]$$

denotes the logarithmized frequency response envelope of the preceding signal segment which is calculated from LPC_STAT1.

Upon calculation, the value of SD is downward limited to a minimum value of 1.6. The value limited in this manner is then stored as the current value in a list of previous values SD_MEM[0 . . . 9], the oldest value being previously removed from the list.

Besides the current value for SD, an average value of the previous 10 values of SD is calculated as well, which is stored in SD_MEAN, the values from SD_MEM being used for the calculation.

b) Calculation of the Mean Voicedness:

The results of a voicedness measure (STIMM[0 . . . 1]) were also provided as an input value to the first stage. (These values are between 0 and 1 and were previously calculated as follows:

$$\chi = \frac{\sum_{i=0}^{L-1} s(i)\cdot s(i-\tau)}{\sqrt{\sum_{i=0}^{L-1} s^2(i)\cdot \sum_{i=0}^{L-1} s^2(i-\tau)}}$$

The generation of the short-term average value of $\chi$ over the last 10 signal segments ($m_{cur}$: index of the momentary signal segment) produces the values:

$$STIMM[k] = \frac{1}{10}\sum_{i=m_{cur}-10}^{m_{cur}} \chi_i,\ k = 0, 1$$

two values being calculated for each frame; STIMM[0] for the first half frame and STIMM[1] for the second half frame. If STIMM[k] has a value near 0, then the signal is clearly unvoiced whereas a value near 1 characterizes a clearly voiced speech region.)

To first exclude disturbances in the special case of signals of very low volume (for example, prior to the signal start), the very small values of STIMM[k] resulting therefrom are set to 0.5, namely when their value was below 0.05 (for k=0, 1) up to that point.

The values limited in this manner are then stored as the most current values at point 19 in a list of the previous values STIMM_MEM[0 . . . 19], the most previous values being previously removed from the list.

Now, the mean is taken over the preceding 10 values of STIMM_MEM, and the result is stored in STIMM_MEAN.

The last four values of STIMM_MEM, namely values STIMM_MEM[16] through STIMM_MEM[19], are averaged once more and stored in STIMM 4.

c) Consideration of the Number of Possibly Existing Isolated "Voiced" Frames:

If non-stationary frames should occasionally have occurred in the analysis or the preceding frames, then this is recognized from the value of N_INSTAT2. In this case, a transition into the "stationary" state has occurred only a few frames before. The LPC_STAT1 values required for the second stage which are provided in the first stage, however, should not immediately be forced to a new value in this transition zone but only after several "safety frames" to be waited for. For the case that N_INSTAT2>0, therefore, internal threshold value TRES_SD_MEAN which is used for the subsequent decision is set to a different value than otherwise.

TRES_SD_MEAN=4.0 (if N_INSTAT2>0)

TRES_SD_MEAN=2.6 (otherwise)

d) Decision

To make the decision, initially, both SD itself and its short-term average value over the last 10 signal segments SD_MEAN are looked at. If both measures SD and SD_MEAN are below a threshold value TRES_SD and TRES_SD_MEAN, respectively, which are specific for them, then spectral stationarity is assumed.

Specifically, it applies for the threshold values that:

TRES_SD=2.6 dB

TRES_SD_MEAN=2.6 or 4.0 dB (compare c)

and it is decided that

STAT1="stationary" if (SD<TRES_SD) AND (SD_MEAN<TRES_SD_MEAN),

STAT1="non-stationary" (otherwise).

However, within a speech signal which should be classified as "non-stationary" according to the objective of VAD, segments can also occur for a short time which are considered to be "stationary" according to the above criterion. However, such segments can then be recognized and excluded via voicedness measure STIMM_MEAN. If the current frame was classified as "stationary" according to the above rule, then a correction can be carried out according to the following rule:

STAT1="non-stationary" if (STIMM_MEAN≧0.7) AND (STIMM4<=0.56)

or (STIMM_MEAN<0.3) AND (STIMM4<=0.56)

or STIMM_MEM[19]>1.5.

Thus, the result of the first stage is known.

e) Preparation of the Values for the Second Stage

The second stage works using a list of linear prediction coefficients which is prepared in this stage, the linear prediction coefficients describing the signal portion that has last been classified as "stationary" by this stage. In this case, LPC_STAT1 is overwritten by the current LPC_NOW (update):

LPC_STAT1[k]=LPC_NOW[k], k=0 . . . 0RDER−1 if

STAT1="stationary"

Otherwise, the values in LPC_STAT1 are not changed and thus still describe the last signal section that has been classified as "stationary" by the first stage.

Temporal Stationarity (Stage 2):

If a signal segment is observed in the time domain, then it has an amplitude or energy profile which is characteristic of the observed period of time. If the energy of temporally successive signal segments remains constant or if the deviation of the energy is limited to a sufficiently small tolerance interval, then one can speak of temporal stationarity. The presence of a temporal stationarity is analyzed in the second stage.

The second stage uses as input the following values the current speech signal in sampled form (SIGNAL [0 . . . FRAME_LEN−1], FRAME_LEN=240)

VAD decision of the first stage: STAT1 (possible values: "stationary", "non-stationary")

the linear prediction coefficients describing the last "stationary" frame (LPC_STAT1[0 . . . 13])

the energy of the residual signal of the previous stationary frame (E_RES_REF)

a variable START which controls a restart of the value adaptation (START, values="true", "false")

The second stage produces, as output, the values final decision on stationarity: STAT2 (possible values: "stationary", "non-stationary")

the number of frames (N_INSTAT2, values=0, 1, 2, etc.) which have been classified as "non-stationary" by the second stage of the algorithm in the analysis of the preceding frames and the number of immediately preceding stationary frames N_STAT2 (values=0, 1, 2, etc.).

variable START which was possibly set to a new value.

For the VAD decision of the second stage, the time rate of change of the energy of the residual signal is used which was calculated with LPC filter LPC_STAT1 adapted to the last stationary signal segment and with current input signal SIGNAL. In this context, both an estimate of the most recent energy of the residual signal E_RES_REF as well as a lower reference value and a previously selected tolerance value E_TOL are considered in the decision. Then, the current energy value of the residual signal must not exceed reference value E_RES_REF by more than E_TOL if the signal is to be considered "stationary".

The determination of the relevant quantities is described below.

a) Calculation of the Energy of the Residual Signal

Input signal SIGNAL[0 . . . FRAME_LEN−1] of the current frame is inversely filtered using the linear prediction coefficients stored in LPC_STAT1 [0 . . . ORDER−1]. The result of this filtering is denoted as; "residual signal" and stored in SPEECH_RES[0 . . . FRAME_LEN−1].

Thereupon, the energy E_RES of this residual signal SIGNAL_RES is calculated:

E_RES=Sum{SIGNAL_RES[k]*SIGNAL_RES[k]/FRAME_LEN}, k=0 . . . FRAME_LEN−1 and then expressed logarithmically:

E_RES=10*log(E_RES/E_MAX),

Where

E_MAX=SIGNAL MAX*SIGNAL_MAX

SIGNAL_MAX describes the maximum possible amplitude value of a single sample value. This value is dependent on the implementation environment; in a prototype based on an embodiment of the present invention, for example, it amounted to SIGNAL_MAX=32767; in other application cases, one would possibly have to put, for example:

SIGNAL_MAX =1.0

Value E_RES calculated in this manner is expressed in dB relative to the maximum value. Consequently, it is always below 0, typical values being about −100 dB for signals of very low energy and about −30 dB for signals with comparatively high energy.

If calculated value E_RES is very small, then an initial state exists, and the value of E_RES is downward limited:

if (E_RES<−200):
E_RES=−200
START=true

Actually, this condition can be fulfilled only at the beginning of the algorithm or in the case of very long very quiet pauses, so that it is possible to set value START=true only at the beginning.

Under this condition, the value of START is set to false:

if (N_INSTAT2>4):
START=false

To ensure the calculation of the reference energy of the residual signal also for the case of low signal energy, the following condition is introduced:

if (START=false) AND (E_RES<−65.0):
STAT1="stationary"

In this manner, the condition for the adaptation of E_RES_REF is enforced also for very quiet signal pauses.

By using the energy of the residual signal, an adaptation to the spectral shape which has last been classified as stationary is carried out implicitly. If the current signal should have changed with respect to this spectral shape, then the residual signal will have a measurably higher energy than in the case of an unchanged, uniformly continued signal.

b) Calculation of the Reference Energy of the Residual Signal E_RES_REF

Besides the frequency response envelope described by LPC_STAT1 of the frame that has last been classified as "stationary" by the first stage, in the second stage, the residual energy of this frame is stored as well and used as a reference value. This value is denoted by E_RES_REF. The residual energy is always redetermined exactly when the first stage has classified the current frame as "stationary". In this case, previously calculated value E_RES is used as a new value for this reference energy E_RES_REF:

If STAT1="stationary" then set
E_RES_REF=E_RES if
(E_RES<E_RES_REF+12 dB) OR
(E_RES_REF<−200 dB) OR
(E_RES<−65 dB)

The first condition describes the normal case: Consequently, an adaptation of E_RES_REF almost always takes place when STAT1="stationary", because the tolerance value of 12 dB is intentionally selected to be large. The other conditions are special cases; they cause an adaptation at the beginning of the algorithm as well as a new estimate in the case of very low input values which are in any case intended to be taken as a new reference value.

c) Determination of Tolerance Value E_TOL

Tolerance value E_TOL specifies for the decision criterion a maximum permitted change of the energy of the residual signal with respect to that of the previous frame in order that the current frame can be considered "stationary". Initially, one sets E_TOL=12 dB Subsequently, however, this preliminary value is corrected under certain conditions:

if N_STAT2<=10:
E_TOL=3.0 otherwise
if E_RES<−60:
E_TOL=13.0 otherwise
if E_RES>−40:
E_TOL=1.5 otherwise
E_TOL=6.5

The first condition ensures that a stationarity which, until now, has only been present for a short period of time, can be exited very easily in that the decision of "non-stationary" is made more easily due to low tolerance E_TOL. The other cases include adaptations which provide most suitable values for different special cases, respectively (it should be more difficult for segments of very low energy to be classified as "non-stationary"; segments with comparatively high energy should be classified as "non-stationary" more easily).

d) Decision

The actual decision now takes place using the previously calculated and adapted values E_RES, E_RES_REF and E_TOL. Moreover, both the number of consecutive "stationary" frames N_STAT2 and the number of preceding non-stationary frames N_INSTAT2 are set to current values.

The decision is made as follows:

if (E_RES>E_RES_REF+E_TOL):
STAT2="non-stationary"
N_STAT2=0
N_INSTAT2=N_INSTAT2+1 otherwise
STAT2="stationary"
N_STAT2=N_STAT2+1
If N_STAT2>16:
N_INSTAT=0

Thus, the counter of the preceding stationary frames N_STAT2 is set to 0 immediately when a non-stationary frame occurs whereas the counter for the preceding non-stationary frames N_INSTAT2 is set to 0 only after a certain number of consecutive stationary frames are present (in the implemented prototype: 16). N_INSTAT2 is used as an input value of the first stage where it influences the decision of the first stage. Specifically, the first stage is prevented via N_INSTAT2 from redetermining coefficient set LPC_STAT1 describing the envelope spectrum before it is guaranteed that a new stationary signal segment is actually present. Thus, short-term or isolated STAT2="stationary" decisions can occur but it is only after a certain number of consecutive frames classified as "stationary" that coefficient set LPC_STAT1 describing the envelope spectrum is also redetermined in the first stage for the then present stationary signal segment.

According to the principle of operation described for the second stage and the introduced parameters, the second stage will never change a STAT1="stationary" decision of the first stage to "non-stationary" but will always make the decision STAT2="stationary" in this case as well.

A "STAT1="non-stationary" decision of the first stage, however, can be corrected by the second stage to a STAT2="stationary" decision or also be confirmed as STAT2="non-stationary". This is the case, in particular, when the spectral non-stationarity which has resulted in STAT1="non-stationary" in the first stage was caused only by isolated spectral fluctuations of the background signal. However, this case is decided anew in the second stage, taking account of the energy.

It goes without saying that the algorithms for determining the speech activity, the stationarity and the periodicity must or can be adapted to the specific given circumstances accordingly. The individual threshold values and functions mentioned above are only exemplary and generally have to be found by separate trials.

What is claimed is:

1. A method for determining speech activity in a signal segment of an audio signal, the method comprising:

assessing, in a first stage, whether spectral stationarity is present in the signal segment;

assessing, in a second stage, whether temporal stationarity is present in the signal segment; and making a decision on the presence of speech activity in the signal segment based on outputs of the first and second stages.

2. The method as recited in claim 1 wherein the assessing whether spectral stationarity is present and the assessing whether temporal stationarity is present are performed using at least one temporally preceding signal segment.

3. The method as recited in claim 2 wherein the assessing the temporal stationarity is performed using an energy change.

4. The method as recited in claim 1 further comprising dividing the signal segment into at least two subsegments and determining speech activity for each subsegment.

5. The method as recited in claim 4 wherein the two subsegments overlap.

6. The method as recited in claim 4 further comprising assessing speech activity of a temporally subsequent signal segment using the respective speech activities of the subsegments.

7. The method as recited in claim 6 further comprising assessing the speech activity of the temporally subsequent signal segment using respective speech activities of subsegments of each preceding signal segment.

8. The method as recited in claim 1 wherein the assessing whether spectral stationarity is present is performed by determining a spectral distortion between the signal segment and at least one preceding signal segment.

9. The method as recited in claim 1 wherein the assessing whether spectral stationarity is present is performed by making a stationarity decision so as to assign a value of stationary or non-stationary to an output variable STAT1.

10. The method as recited in claim 9 wherein the stationarity decision is made using previously determined linear prediction coefficients of the signal segment and a previously determined measure for a voicedness of the signal segment.

11. The method as recited in claim 10 wherein the stationarity decision is made using a number of signal segments N_INSTAT2 which have been classified as non-stationary by the second stage in analysis of preceding signal segments.

12. The method as recited in claim 10 wherein the stationarity decision is made by computing values for preceding signal segments.

13. The method as recited in claim 12 wherein the values for preceding signal segments include at least one of STIMM_MEM[0 . . . 1] and LPC_STAT1.

14. The method as recited in claim 1 further comprising producing a first output value STAT1 having a value of stationary or non-stationary and a second output value LPC_STAT1 which is dependent on previously determined linear prediction coefficients of the signal segment and STAT1.

15. The method as recited in claim 1 wherein the assessing whether temporal stationarity is present is performed using as input variables at least the signal segment in sampled form and a stationarity decision of the first stage.

16. The method as recited in claim 15 wherein the assessing whether temporal stationarity is present is performed using as additional input variables:

linear prediction coefficients LPC_STAT1 describing a last stationary signal segment;

an energy E_RES_REF of a residual signal of a previous stationary signal segment; and a variable START configured to control a restart of a value adaptation and capable of assuming values true and false.

17. The method as recited in claim 1 wherein:

the assessing whether spectral stationarity is present is performed by making a stationarity decision so as to assign a value of stationary or non-stationary to a first output variable STAT1; and the assessing whether temporal stationarity is present is performed so as to assign a value of stationary to a second output variable STAT2 each time that STAT1 has a value of stationary.

18. The method as recited in claim 1 wherein the assessing whether temporal stationarity is present performed so as to assign a value of stationary or non-stationary to a second output variable STAT2, the value of STAT2 being a measure of the speech activity of the signal segment.

19. A method for determining speech activity in a signal segment of an audio signal, the method comprising:

comparing a first evaluation of the signal segment with a first threshold value to determine whether spectral stationary is present in the signal segment;

comparing a second evaluation of the signal segment with a second threshold value to calculate whether temporal stationarity is present in the signal segment; and determining a presence of speech activity in the signal segment based on a comparison of the first and second evaluations of the signal segment.

20. A method for determining speech activity in a single segment of an audio signal, the method comprising:

dividing the signal segment into a series of frames:

calculating a spectral distance between a current frame of the signal segment and a preceding frame of the signal segment;

calculating a mean value of a voicedness of the signal segment;

comparing the spectral distance and mean value of voicedness to respective threshold values to determine if the signal segment has spectral stationarity;

determining if the signal segment has temporal stationarity based on an energy calculation of the frames; and deciding if the signal segment contains speech activity based on the presence of spectral stationarity and temporal stationarity.

21. The method as recited in claim 20, wherein the determining if the signal segment has temporal stationarity further comprises:

determining if the energy of temporally successive frames remains constant; and determining if a deviation of the energy of temporally successive frames is within a tolerance interval.

* * * * *